US005655802A

United States Patent [19]

Topp et al.

[11] Patent Number: 5,655,802

[45] Date of Patent: Aug. 12, 1997

[54] SECURITY CLIP AND METHODS FOR PACKAGE STRAPS

[76] Inventors: Mark Topp, 4530 NW. 102 Ct., Miami, Fla. 33178; David Topp, 2843 S. Bayshore Dr., Miami, Fla. 33133

[21] Appl. No.: 519,141

[22] Filed: Aug. 24, 1995

[51] Int. Cl.[6] ..... B65D 27/30

[52] U.S. Cl. ..... 292/307 R; 292/325

[58] Field of Search ..... 292/307 R, 325

[56] References Cited

U.S. PATENT DOCUMENTS

| | | | |
|---|---|---|---|
| 936,852 | 10/1909 | Baruch et al. | 292/325 |
| 946,486 | 1/1910 | Bassington | 292/325 |
| 997,186 | 7/1911 | Flora | 292/325 |
| 1,006,346 | 10/1911 | Baruch | 292/325 |
| 1,080,182 | 12/1913 | Tyden | 292/313 |
| 1,080,823 | 12/1913 | Freschi | 292/325 |
| 1,252,680 | 1/1918 | Flora | 292/325 |
| 1,510,468 | 10/1924 | Dugan et al. | 292/325 |
| 1,517,515 | 12/1924 | McGary | 292/325 |
| 2,046,634 | 7/1936 | Johnson | 292/325 X |

*Primary Examiner*—Rodney M. Lindsey
*Assistant Examiner*—Monica E. Millner

[57] ABSTRACT

Methods and apparatus for securing a strapped carton against pilferage is disclosed. A security clip includes a common member having two or more foldable over and crimpable prongs extending therefrom at right angles to each other. The security clip is applied to cross straps around the carton. A hole may be provided through the clip and cross straps within which a once only lockable member is inserted.

7 Claims, 4 Drawing Sheets

SECURITY CLIP AND METHODS FOR PACKAGE STRAPS

BACKGROUND OF THE INVENTION

1. Field of the Invention

This invention relates in general to the field of sealing cartons, boxes, or packages and in particular to the field of strapping shipping cartons with secure apparatus such that the straps cannot come loose during shipment and cannot be surreptitiously removed by thieves.

2. Description of the Prior Art

Valuable goods are typically shipped via public or private cargo carriers and are often subject to surreptitious pilferage and theft. The theft usually occurs in unsecured storage and warehouse areas or even in transit while en route to the final destination. The result is loss of the goods which very often is born by the sender or the receiver of the goods and not the carrier or the insurance company because such theft can not be detected until after the receipt and signing off by the recipient. The present invention is intended to overcome this problem.

The method used by the thieves is simply to either slide the straps off the box or to loosen the straps by uncrimping the clip holding the straps, remove the goods and then re-strapping the carton. The more devious thieves replace the dead weight of the removed goods with commonly available objects of equal weight. Once the package is delivered and accepted by the receiver the theft is found, but; then it is too late. The carrier denies liability because he has no way of knowing if the receiver is being truthful. When a number of different carriers are involved, the problem is compounded. There is no way of determining who is at fault. The theft could have occurred by any of the various personnel involved. The denial of liability even extends to the insurance provider. The insurance provider also has no way of determining whether the receiver is being truthful.

One prior art method of sealing the shipping boxes comprises using sealing tape. Removal of the sealing tape, however is relatively easily accomplished and can be done in such a way that detection is almost impossible. Thus, packages secured with sealing tape are very susceptible to theft.

Another prior art method of securing shipped goods, and probably the most common, is the use of metal or reinforced plastic straps. The straps are applied in one direction around the box, made tight by a special tool and then fastened by the use of metal clips. The clips comprise flattened pieces of metal which are bent around the tightened ends of the straps and then crimped in place. One strap may be used or a number of straps may be used. The straps may also be cris-crossed in different directions around the box so that one goes along the length of the box and another goes along the width of the box. However, the straps are individual straps and are not connected to each other. It is therefore possible to slide off one strap, then the other, remove the goods and slide the straps back on. Again the theft is easily accomplished and undetected.

The rough handling packages typically receive in shipping, aids in the undetectability of theft. So too does the fact that shipping cartons are usually made of craft paper or corrugated cardboard. Rough handling during shipment regularly occurs which damages the carton and may cause loosening of the straps. When received at the final destination the receiver almost always assumes that a damaged carton and loose straps were caused by rough handling instead of theft. But upon opening the carton a theft may be discovered.

Tamper evident security tapes and serialized tags have also been used in the never ending attempt to thwart thievery. The tamper evident tapes are subject to shipping damage just as the straps and the cartons, so that a receiver cannot determine if the damage was caused by shipping or thieves. The serialized tags can only be opened by destruction of the tag. But since the tags must be used with straps, it is an easy matter to remove the straps leaving the tag intact and then reapplying new straps. Thus, while tamper evident tapes and serialized tags help prevent theft, their use is easily avoided by clever thieves.

Accordingly, primary objects of the present invention are to provide methods and apparatus for sealing shipping cartons containing valuable goods which makes thievery impossible or nearly impossible but yet allows for easy application of securing straps, provides for greater strength, is convenient to use, and is inexpensive.

SUMMARY OF THE INVENTION

The present invention accomplishes the above stated objectives, as well as others, as may be determined by a fair reading and interpretation of the specification herein including the drawings, abstract and claims appended thereto, by providing a new and improved Security Clip for Package Straps.

The above objects as well as others are accomplished by the present invention which comprises a single monolithic clip having two, three, or four crimping members contained in the single clip. In one preferred embodiment the clip comprises a center portion having four crimpable members extending radially therefrom at right angles to each other. One pair of axially aligned crimping members is used to secure one strap extending around the carton in one direction. The other pair of axially aligned crimping members is used to secure another strap extending around the carton in a direction at a right angle to the first strap.

In the preferred embodiment of the present invention a hole is provided in the center of the center portion which is aligned with holes in the straps for insertion there through of a serialized seal such as a locking tag, a globe seal, a lead ball seal or the like. The holes in the straps may be provided before or at the same time as when the package is sealed.

BRIEF DESCRIPTION OF THE DRAWINGS

Various other objects, advantages, and features of the invention will become apparent to those skilled in the art from the following discussion taken in conjunction with the following drawings, in which.

DETAILED DESCRIPTION OF THE PREFERRED EMBODIMENTS

Figure 1:
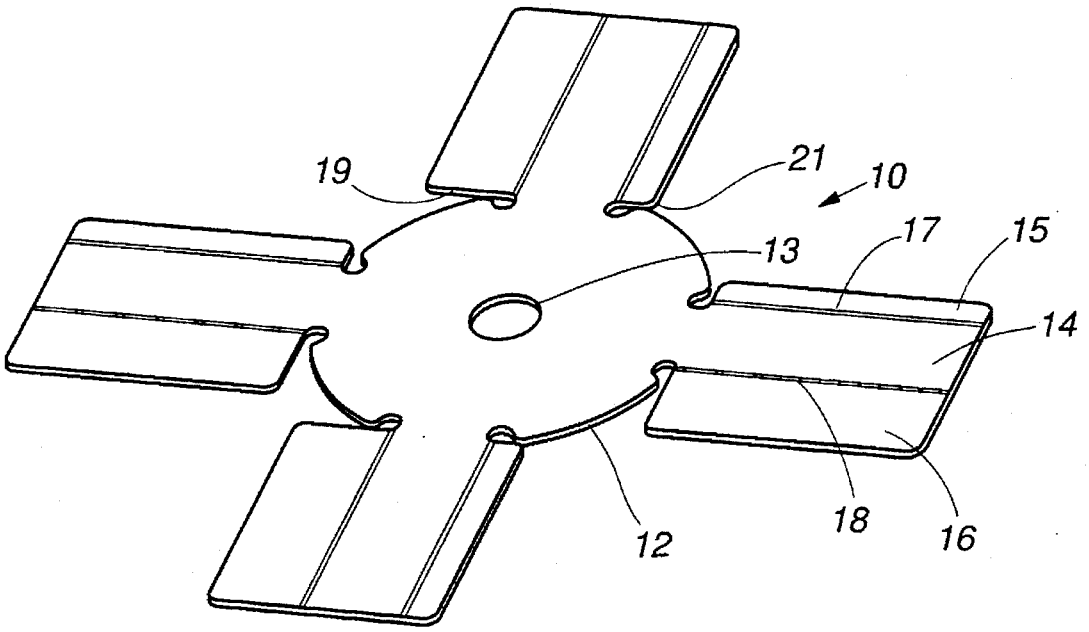
FIG. 1 is an isometric view of one preferred embodiment of the present invention.

As required, detailed embodiments of the present invention are disclosed herein; however, it is to be understood that the disclosed embodiments are merely exemplary of the invention which may be embodied in various forms. Therefore, specific structural and functioning details disclosed herein are not to be interpreted as limiting, but merely as a basis for the claims and as a representative basis for teaching one skilled in the art to variously employ the present invention in virtually any appropriately detailed structure.

Reference is now made to the drawings, wherein like characteristics and features of the present invention shown in the various figures are designated by the same reference numerals.

The apparatus shown isometrically in FIG. 1 comprises a four bladed or pronged security clip 10 in a flat configuration before it is applied to a package or container 11. Clip 10 may be made from sheet metal such as steel or aluminum of appropriate thickness and having appropriate ductility. A center member 12 may have a circular configuration; a square, rectangular, or other geometric configurations are also acceptable and contemplated within the scope of the invention.

Four prong members 14 extend from center member 12 at substantially right angles to each other. Each opposite pair of prongs 14 are substantially aligned with each other along their longitudinal axis. Prong members 14 are physically attached to center member 12. Each prong member 14 includes a pair of oppositely extending flap portions 15 and 16 which are intended to be bent 180 degrees along bend lines 17 and 18, respectively. The inner reaches 19 and 21 of flap portions 15 and 16 may abut the circumference of member 12 or may extend a spaced distance therefrom. Flap portion 15 may be larger than flap portion 16. Flap portions 15 and 16 are physically connected to prongs 14.

Figure 2:
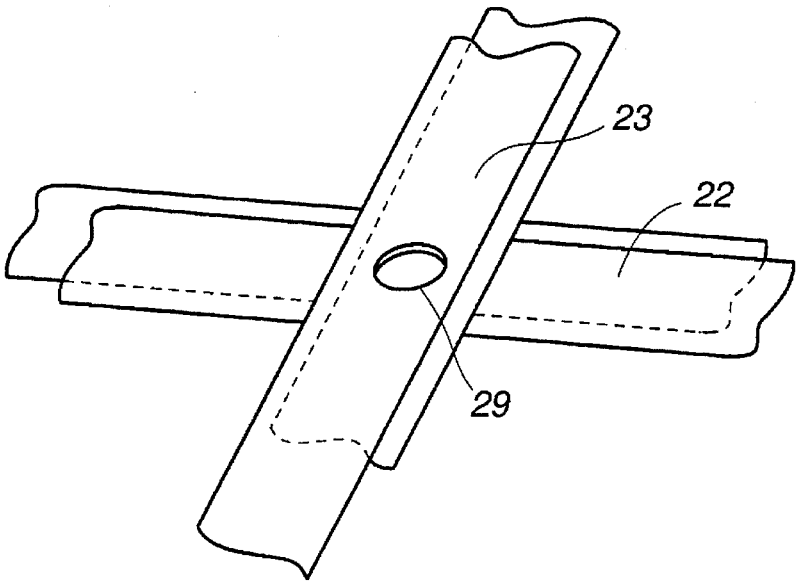
FIG. 2 is an isometric view of cross straps to be used with the clip of FIG. 1 to secure a carton.
Figure 3:
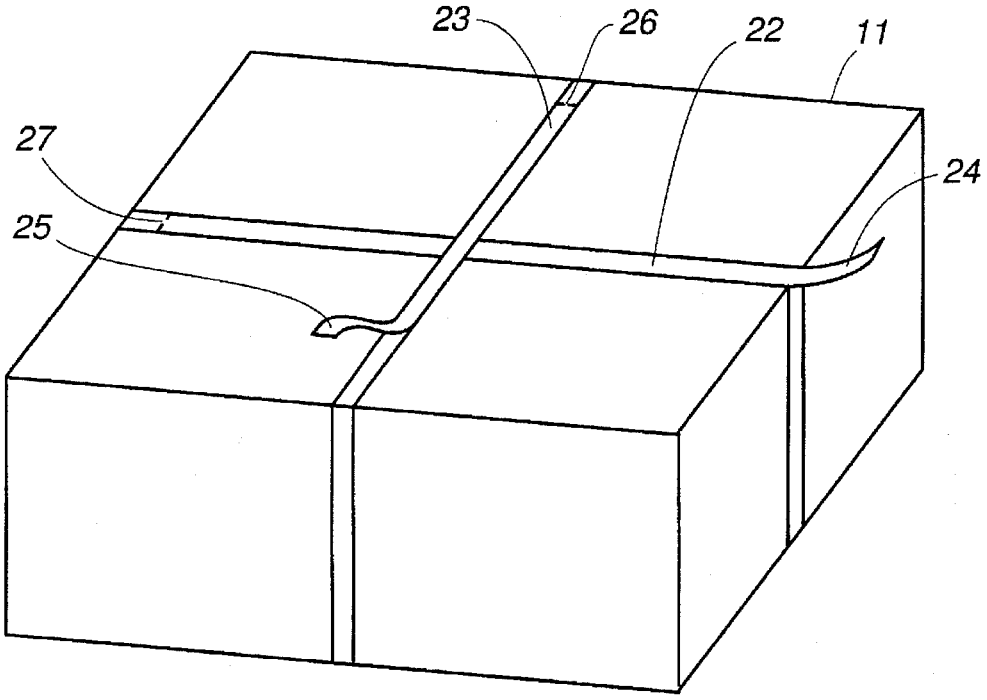
FIG. 3 is an isometric view of a typical carton being secured with cross straps.

As shown in FIGS. 2 and 3, cross straps 22 and 23 are arranged at substantially fight angles to each other such that one strap extends around two opposite sides of a carton 11 while the other strap extends around the two other opposite sides of the carton 11. Straps 22 and 23 may be made from steel or a fiberglass reinforced plastic as are routinely used to strap cartons. Straps 22 and 23 are advantageously arranged such that a double thickness of the straps are provided where they cris cross each other at the location of the clip 10.

Each strap 22 and 23 may be separately tensioned by using standard tensioning apparatus so that they fit tightly around the opposite sides of carton 11. It is advantageous to sufficiently tension straps 22 and 23 such that the edges of the carton 11 under the straps are somewhat compressed or deformed. Ends 24 and 25 of straps 22 and 23 are schematically shown in FIG. 3. The other ends of straps 22 and 23 are schematically shown as dashed lines 26 and 27 and lie thereunder.

Figure 4:
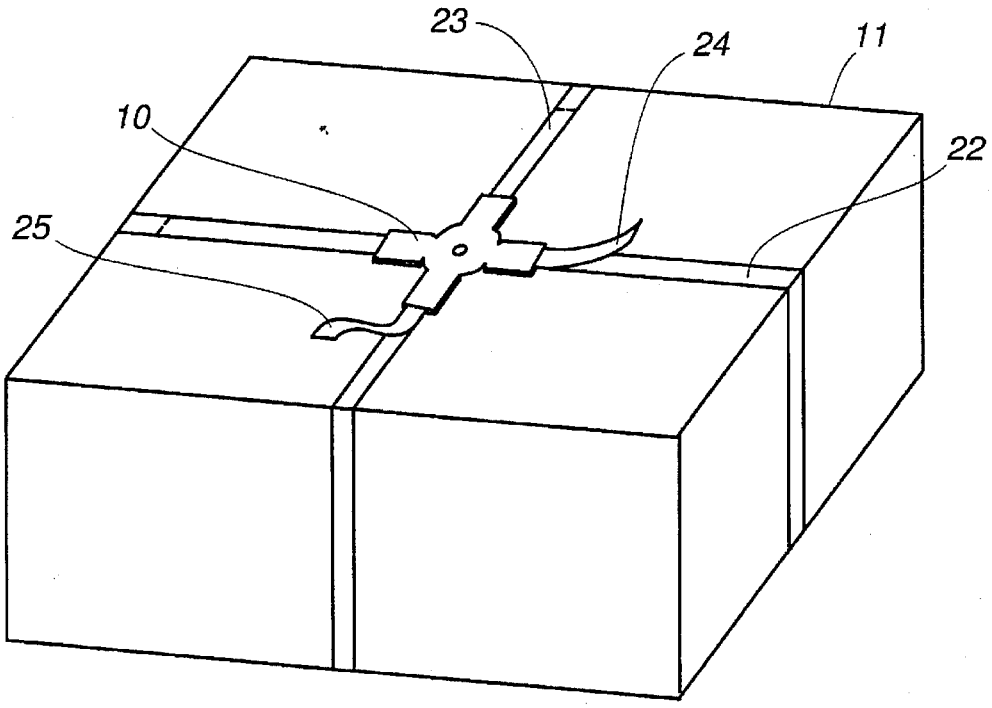
FIG. 4 is an isometric view of the carton and straps of FIG. 3 with the clip of FIG. 1 being attached thereto.

Upon tensioning one of the straps 22 or 23 the security clip 10 is applied as shown in FIG. 4. The two opposite prong members 14 which are aligned with the strap being tensioned are crimped thereto using standard crimping apparatus. Then the other of straps 22 or 23 is similarly tensioned and the respective aligned but opposite prong members 14 are crimped to that strap. Carton 11 is now fully strapped and secured thereby in that it is substantially impossible for a would be thief to simultaneously slide straps 22 and 23 off of carton 11 to gain access thereto.

Figure 5:
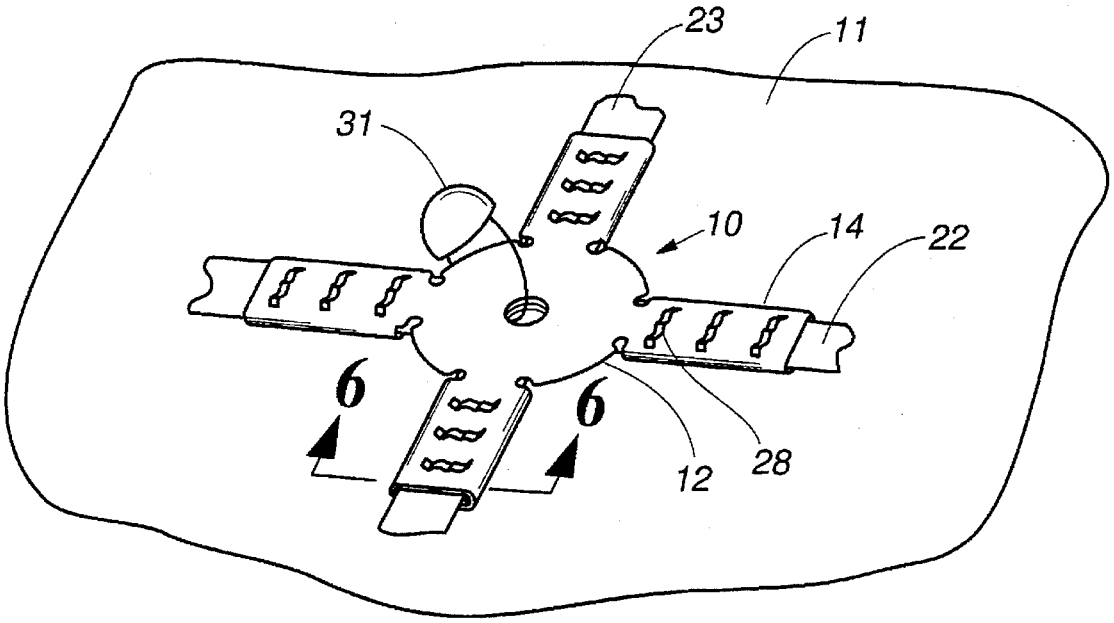
FIG. 5 is a partial isometric view of the carton of FIG. 4 including the attachment of a locking seal.
Figure 6:
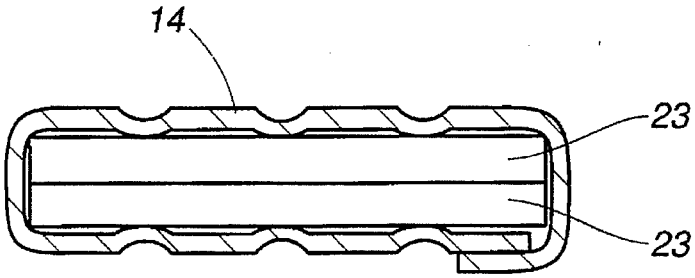
FIG. 6 is a cross sectional view of a crimped clip taken along the line 6—6 of FIG. 5.

FIG. 5 shows an enlarged view of the inplace clip 10 as applied to straps 22 and 23 which secure carton 11. A cross sectional view of the crimping of a prong member 14 is shown in FIG. 6. The double thickness of strap 23 is completely encompassed by the bent over flaps 15 and 16 and further held tightly by crimps 28, the latter being attained by the appropriate crimping tool.

In order to provide further security against surreptitious pilfering, a through hole 13 may be provided in center member 12 together with through and aligned holes 29 in straps 22 and 23. The through hole 13 in center member 12 may be provided when clip 10 is manufactured. The through holes 29 in straps 22 and 23 may be punched at the time of the sealing of the package 11 after or before the clip 10 is applied. A serialized security lock or seal 31 may be simultaneously fitted through holes 13 and 29 and locked thereto. The serialized security lock may be of a type which is lockable only once and must be destroyed to open. A number of such security locks or seals are presently available such as a globe seal or a leadball seal. In this manner the only way to remove the straps 22 and 23 by a would be thief is to break seal 31. And since it is serialized and listed on the shipping documents, the recipient would immediately know that pilferage has occurred without opening carton 11.

Figure 7:
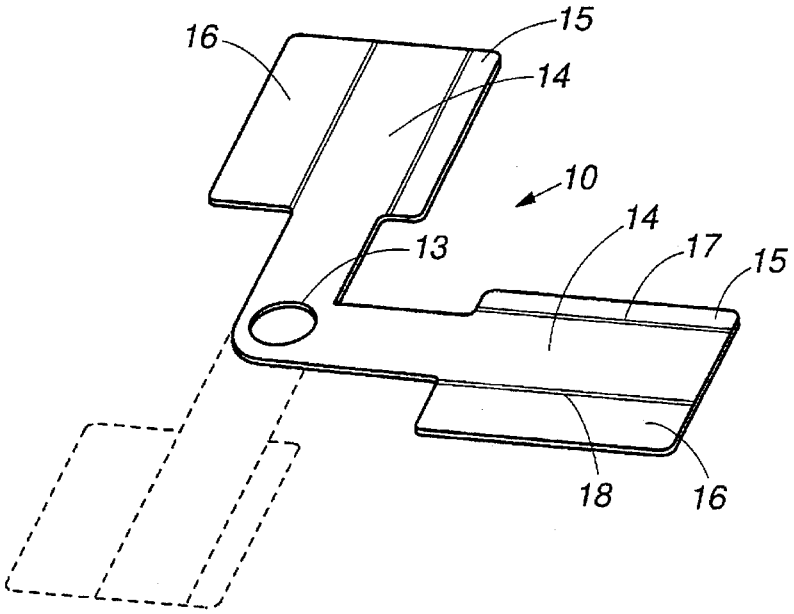
FIG. 7 is an isometric view of another preferred embodiment of the clip according to the present invention.

Another embodiment of the security clip 10 is shown in FIG. 7. In this embodiment only two prong members 14 are provided at a right angle to each other. If desired a third prong 14 may be provided as shown in phantom in FIG. 7.

Figure 8:
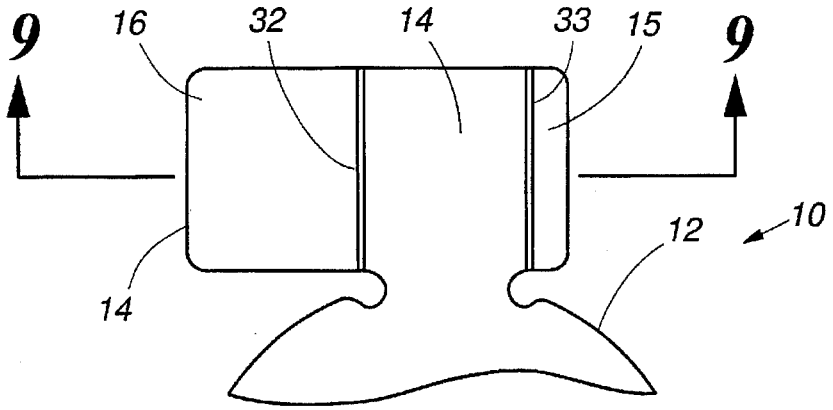
FIG. 8 is a partial top plan view of another embodiment of one of the locking clips according to the present invention.
Figure 9:
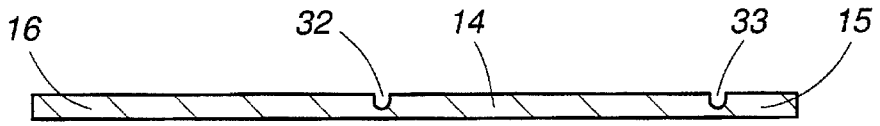
FIG. 9 is a cross sectional view of the clip of FIG. 8 taken along the line 9—9 thereof.

Yet another embodiment is shown in FIGS. 8 and 9. In this embodiment, score lines 32 and 33 are provided along the longitudinal juncture of flaps 15 and 16. Score lines 32 and 33 permit flaps 15 and 16 to be bent over on appropriate strap 22 or 23 and crimped 28 in place; but when an attempt is made to unbend and then rebend flaps 15 and 16 by a would be thief, one or more of the flaps would break off because of metal fatigue occurring at the score lines 32 and 33. The depth of score lines 32 and 33 is readily determined according to the thickness of and the ductility of the metal from which the clip 10 is made. This embodiment would also frustrate a would-be-thief because of the obvious signs of pilferage and his inability to resecure the straps 22 or 23.

The above described embodiments of the present invention thereby accomplish the stated objectives by providing a substantially theft proof method and apparatus for strapping and securing shipping containers for valuable goods.

While the invention has been described, disclosed, illustrated and shown in certain terms or certain embodiments or modifications which it has assumed in practice, the scope of the invention is not intended to be nor should it be deemed to be limited thereby and such other modifications or embodiments as may be suggested by the teachings herein are particularly reserved especially as they fall within the scope of the breadth and scope of the claims here appended.

We claim as our invention:

1. A security clip adapted to be attached to cross straps attached to a carton comprising a substantially planar member having a center member, at least two prong members extending from said center member at substantially right angles to each other, said prong members having two opposite longitudinal side edges and one end edge transverse to said side edges, said side edges including a foldable flap extending outward from and along said side edge, said foldable side flaps being bendable for attachment around said cross-straps.

2. The security clip apparatus of claim 1, wherein said prong members comprise four prong members each at a substantially right angle to an adjacent prong member.

3. The security clip apparatus of claim 1, wherein said center member includes a hole through the approximate center thereof.

4. The security apparatus of claim 1, including at least one score line between said side edge of said prong and said foldable side flap.

5. A method of protecting a carton from pilferage comprising the steps of cross strapping the carton with straps arranged at a right angle to each other around the carton;

applying a security clip having at least two prongs thereon extending at a right angle to each other at a junction of the cross straps with one prong being aligned with one strap and the other prong being aligned with the other strap wherein said prongs have two opposite longitudinal side edges; and bending flaps which extend from said longitudinal side edges of said prongs around each respective strap.

6. The method of claim 5 including the step of crimping each flap to each respective strap.

7. The method of claim 5 including the steps providing aligned holes through said clip and said cross straps, applying a lockable seal simultaneously through said aligned holes and locking said lockable seal.

* * * * *